US012435506B2

(12) United States Patent
Hensley et al.

(10) Patent No.: US 12,435,506 B2
(45) Date of Patent: Oct. 7, 2025

(54) SAFER DUSTLESS METHOD FOR INSTALLING A PRECOMPRESSED EXPANSION JOINT SEALING SYSTEM

(71) Applicant: SIKA TECHNOLOGY AG, Baar (CH)

(72) Inventors: Lester Hensley, Westborough, MA (US); Massimo Demarco, Woodbridge (CA); Eric Muench, Fanwood, NJ (US)

(73) Assignee: SIKA TECHNOLOGY AG, Baar (CH)

( * ) Notice: Subject to any disclaimer, the term of this patent is extended or adjusted under 35 U.S.C. 154(b) by 167 days.

(21) Appl. No.: 18/036,921

(22) PCT Filed: Jan. 14, 2022

(86) PCT No.: PCT/EP2022/050812
§ 371 (c)(1),
(2) Date: May 15, 2023

(87) PCT Pub. No.: WO2022/157086
PCT Pub. Date: Jul. 28, 2022

(65) Prior Publication Data

US 2023/0417047 A1 Dec. 28, 2023

Related U.S. Application Data

(60) Provisional application No. 63/140,428, filed on Jan. 22, 2021.

(51) Int. Cl.
*E04B 1/68* (2006.01)

(52) U.S. Cl.
CPC ..... *E04B 1/6812* (2013.01)

(58) Field of Classification Search
CPC .. E04B 1/6812; E04B 1/6813; E04B 2001/68; E01D 22/00

(Continued)

(56) References Cited

U.S. PATENT DOCUMENTS 4,932,183 A * 6/1990 Coulston ..... E04B 1/6815 52/417
5,130,176 A * 7/1992 Baerveldt ..... B32B 7/12 428/317.1

(Continued)

FOREIGN PATENT DOCUMENTS

CA 2 960 236 A1 9/2018
DE 101 53 548 C1 3/2003

OTHER PUBLICATIONS

May 4, 2022 Search Report issued in International Patent Application No. PCT/EP2022/050812.

(Continued)

*Primary Examiner* — Paola Agudelo
(74) *Attorney, Agent, or Firm* — Oliff PLC

(57) ABSTRACT

Disclosed is a safer, dustless method for installing an expansion joint sealing system without mechanically grinding substrates to improve adhesion. The method includes locating substrates forming a gap between opposing surfaces of the substrates, preparing the surfaces by wiping with a solvent, and applying a mounting band of sealant to the surfaces. The method includes disposing the sealing system in the gap proximate to or within the mounting band, maintaining the sealing system in the gap until the system expands toward the surfaces, embeds within the mounting band and secures the sealing system in position between opposing surfaces. The method also includes prior to the preparing the surfaces, removing an existing joint sealing system by cutting sealant between the existing system and the substrates, wiping surfaces with solvent, and leaving any deformation or embedded residue from the removed sealing system on or embedded in the surfaces of the substrates.

8 Claims, 8 Drawing Sheets

(58) Field of Classification Search
USPC ..... 52/741.4
See application file for complete search history.

(56) References Cited

U.S. PATENT DOCUMENTS 5,935,695 A * 8/1999 Baerveldt ..... B32B 5/18 428/317.1
8,365,495 B1 * 2/2013 Witherspoon ..... E04B 1/98 52/396.01
10,815,658 B2 * 10/2020 Danna ..... E04B 1/6801
10,920,417 B2 * 2/2021 Hulteen ..... E04B 1/948
2004/0062605 A1 * 4/2004 Lehto ..... E04F 15/14 404/47
2004/0187235 A1 * 9/2004 Elias ..... E01D 19/06 14/73.1
2008/0115440 A1 * 5/2008 Fortney ..... E04F 15/14 52/741.1
2009/0266020 A1 * 10/2009 Sladojevic ..... E04B 1/6813 52/459
2010/0307102 A1 * 12/2010 Barnett ..... E01C 11/10 52/745.19
2013/0133279 A1 * 5/2013 Noonan ..... E04B 1/76 52/309.1
2014/0154008 A1 * 6/2014 Stachowicz ..... E01D 19/06 404/74
2014/0219719 A1 * 8/2014 Hensley ..... E01C 11/14 404/57
2016/0076240 A1 * 3/2016 Hensley ..... E04B 1/6812 52/396.04
2017/0284083 A1 10/2017 Hensley et al.
2019/0194935 A1 * 6/2019 Robinson ..... E04B 1/78
2019/0226340 A1 * 7/2019 Andrick ..... E04B 1/6813
2019/0323347 A1 * 10/2019 Hensley ..... E21D 11/385
2020/0325674 A1 * 10/2020 Robinson ..... E04B 1/61

OTHER PUBLICATIONS

May 4, 2022 Written Opinion of the International Searching Authority issued in International Patent Application No. PCT/EP2022/050812.

* cited by examiner

SAFER DUSTLESS METHOD FOR INSTALLING A PRECOMPRESSED EXPANSION JOINT SEALING SYSTEM

TECHNICAL FIELD

The present disclosure relates generally to joint sealing systems and methods for safer, dustless installation or replacement and reinstallation or retrofit of the same. More particularly, the present disclosure relates to expansion joint sealing systems and steps for installation thereof in joints between substrates forming building or structural components. The substrates include, for example, concrete and other building or structural systems designed to accommodate movement due to, for example, thermal, wind and/or seismic sway, shear and/or load forces, or other building or structural movement. The present disclosure also applies to sealing solutions for many other gaps or joints between substrates of building or structural systems which do not experience large movements but still are required to resist or prevent water ingress, to contain for a period of time heat, flame and/or smoke from a fire, and to provide thermal and other improved sealing characteristics. These gaps or joints between substrates forming building components include, for example, control joints in masonry (brick or concrete masonry unit (CMU)), joints in building or structural façades or exterior insulation and finish systems (EIFS), window perimeter joints, joints in precast concrete or metal panel structures, and others in structures including, but not limited to, buildings, parking garages, stadiums, tunnels, bridges, and the like.

BACKGROUND

Most buildings structures contain expansion joints, control joints, and other gaps between substrates forming building or structural components designed to accommodate movement of the structure. Expansion joints are generally about 0.375 inch (0.9525 cm) or greater in width across the joint and are designed to accommodate thermal expansion and contraction as well as wind, seismic, shear and load generated movements of the building or structural components. Control joints are used to allow for substrates comprised of material including, for example, concrete or brick, to shrink during curing, eliminating tensile forces across the joint thus preventing cracking of the material of the substrate. Window perimeter joints exist to accommodate and allow for inaccuracies in building construction, and to prevent any forces from transferring to the windows themselves. References to expansion and/or building joints below should be understood to be any of a variety of these gaps or joints between substrates forming building or structural components.

Systems designed to seal the expansion and/or building joints may be positioned to extend through both interior and exterior surfaces of the substrates, for example, walls, floors, ceilings, and roofs, of a building or structure. In the case of an exterior joint between substrates forming an exterior wall, floor or roof exposed to external environmental conditions, the expansion joint sealing system should to some degree seal and/or resist the effects of the external environment conditions on the joint. As such, most external expansion joint sealing systems are designed to seal and/or resist the effects of water from penetrating the structure. Sealing systems installed in vertically oriented exterior joints between substrates are designed to resist penetration of water in the form of rain, snow, ice, or debris that is driven by wind. Sealing system installed in horizontally oriented exterior joints between substrates are designed to resist water in the form of rain, standing water, snow, ice, debris such as sand, chemicals used to treat snow and/or ice covered surfaces, and in some circumstances all of these at the same time. Additionally, some sealing systems installed in horizontal joints may be subject to pedestrian and/or vehicle traffic and are designed to withstand such traffic while providing and maintaining the sealing property.

Water resistant or watertight joint sealing systems can exist in different forms, but generally are constructed from materials designed to resist water penetration and to accommodate the physical cycling caused by the building's or structure's movement in response to thermal expansion and/or contraction, wind and/or seismic sway, load and/or shear forces.

Devices have been used to attempt to create watertight expansion joints sealing systems. One such sealing system known as a "caulk and backer rod" system, requires on-site assembly by a skilled applicator to create a finished, functional joint sealing system. These systems can suffer from numerous deficiencies related both to the installation method and the technology itself. Installation problems include difficulty in inserting the backer rod and difficulty setting the appropriate depth of the backer rod. Technological problems include closed cell compression set of the backer rod, potentially poor or no adhesion between backer rod and top coated caulk, caulk in tension, caulk curing in ambient or less than ideal conditions, and caulk curing while movement is occurring in place. Additionally, these problems are typically exacerbated if the system is installed in a movement joint nominally larger than about one (1) inch (2.54 cm) in width across the joint, or installed and expected to operate by accommodating movement larger than about plus or minus ten to fifteen percent (+/−10 to 15%). Such afore-described factors can lead to less than desirable results, such as short life span of the system, low movement capability, and ultimately water ingress and attendant issues thereof. The onsite assembly nature of caulk and backer rod systems can cause installation labor costs to be high, offsetting much of the perceived cost benefits of the cheaper components.

U.S. Pat. No. 5,130,176 describes a sealing system configured to address some of these problems. The described sealing system can eliminate the need for onsite assembly and improve productivity. The described system is particularly effective in joints between substrates larger than about one and one half (1.5) inches (3.81 cm) in width across the joint, and can be used, for example, in joints as large as about twelve (12) inches (30.48 cm) in width across the joint.

A trend in the building industry is toward fewer and larger/wider expansion joints. The trend toward fewer joints is occurring, in part, because expansion joints are typically sited as points of failure for water penetration and for fire containment. Additionally, the trend toward larger/wider joints is due to building codes mandating that larger wind and/or seismic movement be taken into consideration during design and construction.

It has been generally recognized that building joint sealing systems are deficient with respect to fire resistance. In some instances, movement because of building or expansion joints has been shown to create breaks or voids in joint sealing solutions for the joints between substrates that may result in a chimney effect which can have consequences regarding fire containment. This often results in the subversion of fire resistive elements that may be incorporated into the design and construction of the building or structure. This problem is particularly severe in large high-rise buildings, parking garage structures, and stadiums where fire may spread too rapidly to allow the structures to be safely and fully evacuated.

Early designs for fire resistive joint sealing systems included monolithic blocks of mineral wool or other inorganic materials of either monolithic or composite constructions either in combination with or without a field-applied liquid sealant. In general, these designs were adequate for non-moving joints or control joints where movements were small. Where movements were larger and the materials were significantly compressed in response to the normal thermal expansion and contraction, wind and/or seismic sway, load and/or shear forces, or other movement cycling of the building structure, these designs generally did not function as intended. Indeed, many designs simply lacked the resilience or recovery characteristics required to maintain adequate coverage/seal over the entire joint width throughout the normal thermal cycle (expansion and contraction) and other movement cycling that buildings and other structures experience. Many of these designs were tested in accordance with accepted test standards such as, for example, ASTM International's standard titled "Standard Test Methods for Fire Tests of Building Construction and Materials" (ASTM E-119), which provides for fire exposure testing of building components under static conditions and does not take into account the dynamic nature of expansion joint sealing systems. As described above, this dynamic behavior can contribute to the compromise of the water and/or fire resistance properties of some building designs.

Underwriters Laboratories developed a test standard 2079 titled "Tests for Fire Resistance of Building Joint Systems" (UL 2079), a further refinement of the fire endurance requirements of ASTM E-119, by adding a joint movement cycling regimen in the UL 2079 test standard. The joint movement cycling regimen of UL 2079 is substantially similar to a second ASTM International test standard titled "Standard Test Method for Cyclic Movement and Measuring the Minimum and Maximum Joint Widths of Architectural Joint Systems" (ASTM E-1399). Additionally, the UL 2079 standard stipulates that the design be tested at the maximum joint size. The UL 2079 test standard is seen to be more reflective of real world conditions, and as such, architects and engineers have begun specifying expansion joint sealing products that meet it. Many designs which pass ASTM E-119 without the movement cycling regime do not pass the UL 2079 test standard. This may be adequate, as stated above, for non-moving building joints between substrates; however, most building expansion joint systems are designed to accommodate some movement as a result of thermal effects (e.g., expansion into the joint and contraction away from the joint), wind and/or seismic sway, load and/or shear forces. Commonly owned U.S. Pat. No. 8,365,495 and other commonly owned patents describe expansion joint sealing solutions that address both water and fire resistive aspects in unitary expansion joint sealing systems that pass fire endurance and movement cycling testing provided by the UL 2079 test standard.

Additionally, in the field of joint sealing in the built environment there remains a need to initially seal and, subsequently, to maintain the seal of the building or expansion joint by removing old systems and installing replacement joint sealants. Porous substrates between which building and expansion joints are formed range from natural stone, concrete, masonry (e.g., brick, CMU), EIFS, stucco, and the like. Surfaces of these substrates may need to be prepared and/or restored prior to installation of an expansion joint sealing system in the gap or joint formed between the surfaces of the substates. Preparation and/or restoration of the surfaces of the substrates may be required so that the surfaces accept adhesive or other sealant aiding the bond and adhesion between the expansion joint sealing system and the substrates. Preparation and restoration may include, for example, cleaning, scraping, abrading, sanding, grinding, or other treatment to remove dirt, old sealant residue, or other materials that may inhibit formation of a good bond and adhesion between the substrates and the expansion joint sealing system. Preparation and/or restoration may also include leveling the surface to remove high points or to fill voids. As can be appreciated scraping, abrading, sanding, and/or grinding the substrates and materials on the surface of the substrates can release dust or other contaminants as airborne particles. The airborne particles may be harmful to personnel installing the expansion joint sealing system as well as any person in proximity to the work area. For example, it is known that scraping, abrading, sanding, or grinding some materials commonly used as substrates in building structures can release particles that contains silica. Silica is a known health hazard when inhaled by humans.

Safety and other building and health organizations such as, for example, in the U.S. the Occupational Safety and Health Administration (OSHA), as well as state and local building and health departments, administer regulations that set requirements for the protection of workers and building occupants from inhaled free silica and other contaminants. Adherence to these regulations requires that installers use dust collection equipment attached to all cutting, scraping, abrading, sanding, and grinding tools. Dust collection accessories generally make equipment heavier and more cumbersome to operate. In addition, installers typically must use personal protective equipment (PPE) including, for example, self-contained breathing apparatus (SCBA), to meet OSHA requirements to prevent or at least substantially minimize inhalation risk. While desirable for health and safety reasons, the combined use of PPE and dust collection equipment increases costs of installation, slows productivity and can introduce additional strain or introduce other health and safety risks to installers.

Thus, there remains a need for expansion joint sealing systems and methods of installation that eliminate the need for scraping, abrading, sanding, and grinding of surfaces of substrates forming an expansion joint to prepare the surfaces to accept adhesive or other sealant aiding the bond between the expansion joint sealing system and the substrates.

SUMMARY

Accordingly, provided herein according to embodiments are safer systems and methods for installation of the same that resist or prevent water ingress, contain for a period of time heat, flame and/or smoke from a fire, and provide thermal and other improved sealing characteristics, while accommodating structural movements and sealing a joint, among providing other advantages. Embodiments disclosed herein overcome the technological problems of previous building joint seal designs, such as caulk and backer rod, and improve upon the teachings of prior art systems and installation methods.

According to an aspect, a relatively safer, dustless method for installing a precompressed expansion joint sealing system is provided. The method comprises a step of locating in a structure of interest a first substrate and a second substrate, where the second substrate is arranged coplanar with the first substrate and is spaced therefrom by a gap formed between opposing surfaces of the first substrate and the second substrate. The method includes preparing the opposing surfaces of the first substrate and the second substrate without the need to mechanically grind or abrade the substrates by wiping the opposing surfaces with a solvent leaving any surface deformations and residue, and by applying a mounting band of a liquid sealant to the opposing surfaces of the first substrate and the second substrate. The method also includes disposing a precompressed expansion joint sealing system in the gap by locating the expansion joint sealing system in a position between the opposing surfaces and at least in one of proximate to or within the mounting band of the liquid sealant applied to the opposing surfaces of the first substrate and the second substrate. The method includes maintaining the precompressed expansion joint sealing system in the position in the gap until the precompressed expansion joint sealing system expands outwardly toward the opposing surfaces, embeds within the mounting band of sealant and secures the expansion joint sealing system in the position between opposing surfaces of the first substrate and the second substrate.

In one embodiment, the safer, dustless method for installing the precompressed expansion joint sealing system further includes applying a bead of liquid sealant to and between a portion of a top surface of the precompressed expansion joint sealing system and the opposing surfaces of the first substrate and the second substrate.

In still another embodiment, the safer, dustless method for installing the precompressed expansion joint sealing system further includes prior to the preparing the opposing surfaces of the first substrate and the second substrate, steps of locating an existing joint sealing system installed in the gap between the first substrate and the second substrate, and removing the existing joint sealing system by cutting sealant between the existing joint sealing system and the first substrate and the second substrate. In this embodiment, the preparing of the opposing surfaces of the first substrate and the second substrate by wiping further includes wiping the opposing surfaces with the solvent and leaving any embedded residue of sealant remaining from the existing and now removed joint sealing system on or embedded in the opposing surfaces of the first substrate and the second substrate without the need to mechanically grind or abrade the substrates either to prepare the substrates or to remove the residue of a previously installed and removed joint sealing system.

In one embodiment, the safer, dustless method of installing the precompressed expansion joint sealing system includes installing a water resistant and/or fire resistant precompressed expansion joint sealing system. In one embodiment, the water resistant and/or fire resistant precompressed expansion joint sealing system includes fire retardant material introduced into a core of the expansion joint sealing system and the core with the fire retardant material therein has as a compressed density in a range of about 160 kg/m$^3$ to about 800 kg/m$^3$, and the expansion joint sealing system is configured to pass testing provided by UL 2079. In one embodiment, the precompressed expansion joint sealing system further includes a water resistant or water proof resistant coating applied to a surface of the precompressed expansion joint sealing system. In one embodiment the water resistant or water proof resistant coating is paintable.

BRIEF DESCRIPTION OF THE DRAWINGS

Referring now to the Figures, which are exemplary embodiments, and wherein like elements are numbered alike.

DETAILED DESCRIPTION

Embodiments of the present invention relate to a resilient water and/or fire resistant expansion joint sealing system and methods for safer, dustless installation of the same by compressing the system in a gap or joint between substrates forming building or structural components of a structure including, but not limited to, a building, parking garage, stadium, tunnel, bridge, and the like. When installed in the compressed state, the water and/or fire resistant expansion joint sealing systems accommodate thermal expansion and contraction as well as wind, seismic, shear and load generated movements of the building or structural components, if necessary, while maintaining a water resistant, fire resistant, and/or other desirable characteristics as the systems seal the gap or joint. Although other methods and materials may be used in the constructions described herein, particularly suitable and preferred methods and materials are described herein. Unless stated otherwise, any technical or scientific terms used will have the meaning as understood by one of ordinary skill in the art to which the present invention pertains.

Figure 1C:
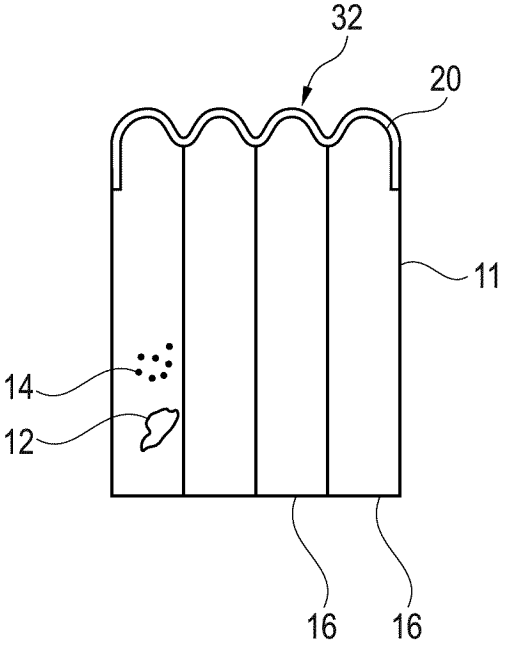
FIG. 1C is a schematic partial section view of the expansion joint sealing system of FIG. 1A after compressing, compiling of a plurality of laminations, and formation of a bellows shaped top surface profile, in accordance with one embodiment.
Figure 1B:
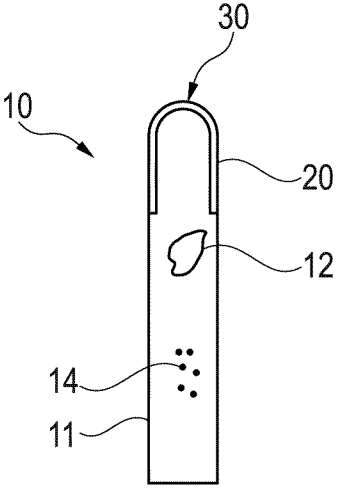
FIG. 1B is a schematic partial section view of the expansion joint sealing system of FIG. 1A after compressing and formation of an arched shaped top surface profile, in accordance with one embodiment.
Figure 1A:
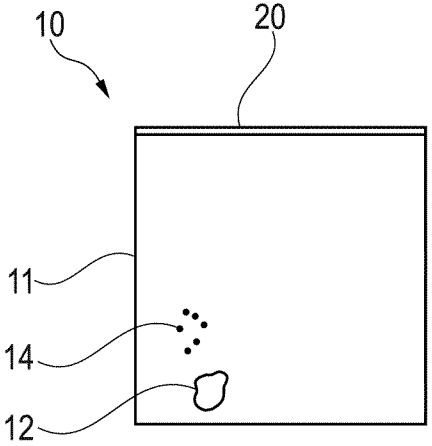
FIG. 1A is a schematic partial section view of coated, precompressed expansion joint sealing system, in accordance with one embodiment.

The expansion joint sealing systems described herein according to embodiments are best understood by referring to the attached drawings. Referring to FIG. 1A, disclosed therein is a partial, section view of one embodiment of an expansion joint sealing system 10 manufactured, installed and operating in accordance with aspects of the present invention. As illustrated in FIGS. 1A to 1C, the expansion joint sealing system 10 includes a core 11 comprised of, for example, one or more strips or laminations 16, or a block, of open celled polyurethane foam material that is treated with at least one of and/or combinations of, a water resistant chemistry 12 such as, for example, an acrylic or a wax, a fire resistant material 14, ultraviolet (UV) stabilizers, and/or polymeric materials, impregnated, infused, dispersed, permeated, put into, included in, or otherwise introduced to at least partially or fully, fill or coat the matrix and/or exterior or interior of the cells of the material of the core 11. It should be appreciated that while in one embodiment the core 11 is described above as being comprised of foam, for example, an open celled polyurethane foam, this material is merely illustrative of one suitable material for the core 11. Other examples of materials for the core 11 include, but are not limited to, polyurethane foam and/or polyether foam, and can be of an open cell or dense, closed cell construction. Further examples of materials for the core 11 include paper based products, cardboard, metal, plastics, thermoplastics, dense closed cell foam including polyurethane and polyether open or closed cell foam, cross-linked foam, neoprene foam rubber, urethane, ethyl vinyl acetate (EVA), silicone, a core chemistry (e.g., foam chemistry) which inherently imparts hydrophobic and/or fire resistant characteristics to the core 11; and/or composites. Combinations of any of the foregoing materials or other suitable material also can be employed to construct the core 11. It is further noted that while foam is primarily referred to herein as a material for the core 11, the descriptions for foam also can apply to other materials for the core, as explained above.

In one embodiment, the strips or laminations 16 are fabricated from larger sheets of material of the core 11 that are typically about one and one half inches (1.5 in.; 3.81 cm) thick by twenty inches (20 in.; 50.8 cm) wide by ten feet (10 ft.; 3.048 m) in length. Other dimensions can be used according to the situation as required. The sheets or blocks of material of the core 11 are preferentially treated by being impregnated, infused, dispersed, permeated, put into, included in, or otherwise introduced with a suitable water resistant chemistry 12 such as, for example, a water based acrylic, ultraviolet (UV) stabilizers, polymeric materials, a fire resistant material 14, individually and/or in combinations. In one embodiment, the ratio by weight of core material to chemical agent (including particles) can be in the range of about 1:1 to about 1:5 by volume, where the ratio is determined in part by the permeability of the core material, and wherein the amount of chemical agent and particles relative to the material of the core 11 will generally increase with increasing permeability. Likewise, because greater porosity or cell size in the core material often produces higher permeability, more chemical agent and core material may, in many cases, be used where the porosity or cell size of the core material is greater. Alternatively, or additionally, larger particles may be used where the porosity or cell size of the core material is greater.

In one embodiment, the fire resistant material 14 is preferentially impregnated, infused, dispersed, permeated, put into, included in, or otherwise introduced in the sheets or blocks of material of the core 11 in a ratio of between about 3.5:1 and 4:1 by weight with respect to the untreated material of the core 11 itself. The resultant uncompressed material of the core 11, whether comprising a solid block or a plurality of laminates, can have a density in a range of about 130 kg/m$^3$ to about 150 kg/m$^3$, specifically 140 kg/m$^3$, according to embodiments. Other suitable densities for the resultant uncompressed material of the core 11 includes densities in a range of between about 50 kg/m$^3$ and about 250 kg/m$^3$, e.g., more particularly, embodiments between about kg/m$^3$ and about 180 kg/m$^3$, or about 100 kg/m$^3$ and about 180 kg/m$^3$, and which are capable of providing desired water resistance and/or waterproofing as well as fire resistance characteristics to the structure. According to embodiments, the material of the core 11 with the water resistant chemistry 12, ultraviolet (UV) stabilizers, polymeric materials and/or the fire resistant material 14 therein may be constructed in a manner which insures that substantially the same density of water resistant chemistry 12 and/or the fire resistant material 14 is present in the expansion joint sealing system regardless of the final size of the system. As a non-limiting example, when compressed the treated material of the core 11 may typically cycle (e.g., expand and contract) between compressed densities in the range of at least about 160 to about 800 kg/m$^3$, according to embodiments. It should be appreciated that the present invention is not limited to treatment within the foregoing uncompressed density ranges and/or cycling in the foregoing compressed density ranges. For example, depending on embodiments, installation and compression ratios, the core 11 may attain densities outside of the herein-described density ranges of, for example, about 50 to about 250 kg/m$^3$ uncompressed and about 160 to about 800 kg/m$^3$ when compressed.

In the embodiments described herein, the treated material of the core 11 may be constructed in a manner which provides that the amount of fire retardant material 14 that is introduced in the core 11 is such that the resultant treated material of the core 11 passes, for example, complies by performing in accordance with, Underwriters Laboratories' UL 2079 movement cycling and fire resistance test program regardless of the final size of the product. For example, in accordance with various embodiments, the amount of fire retardant material 14 that is introduced in the core 11 is such that the resultant material resists and endures movement cycling, by cycling through an intended range of movement (expansion and contraction), followed by meeting conditions for acceptance of a specified fire endurance test. As known to those of skill in the art, the movement cycling tests are specified in Section 9 of UL 2079, while the fire endurance test is specified under Section 11. As required by the test standard, the expansion joint sealing systems 10 described herein pass UL 2079 fire endurance testing by being capable of resisting, enduring and withstanding exposure to one or more times and temperatures illustrated on the UL 2079 time-temperature curve including, for example, a temperature of about 538° C. at about five minutes, a temperature of about 927° C. at about one hour, a temperature of about 1010° C. at about two hours, a temperature of about 1052° C. at about three hours, a temperature of about 1093° C. at about four hours, and up to a temperature of about 1260° C. at about eight hours, without significant compromise in the integrity of the joint sealing system. Optionally, and depending on intended use of the expansion joint sealing system undergoing UL 2079 testing, for example a joint sealing system intended for installation and use in a vertical application (wall mounted system) versus a horizontal application (a floor mounted system), the core 11 may pass other tests describing the UL 2079 including, for example, a hose stream test as specified in Sections 17 and 18 of UL 2079.

Figure 3B:
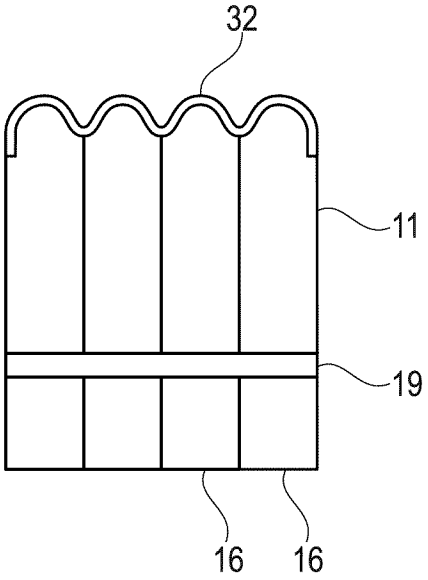
FIG. 3B is a schematic partial section view of an expansion joint sealing system including a layer and after compressing, compiling of a plurality of laminations, and formation of a bellows shaped top surface profile, in accordance with one embodiment.
Figure 3A:
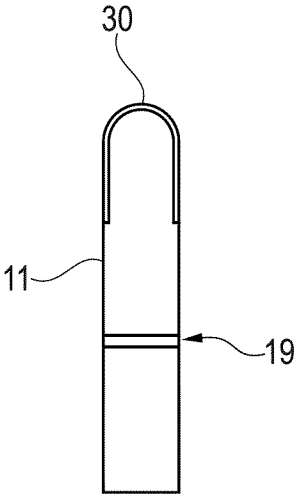
FIG. 3A is a schematic partial section view of an expansion joint sealing system including a layer and after compressing and formation of an arched shaped top surface profile, in accordance with one embodiment.

Further, in all embodiments described herein and as illustrated in FIGS. 3A and 3B, the fire retardant material 14 introduced in the material of the core 11 may be in a form of a layer 19 disposed in the material of the core 11 or between portions of the material of the core 11. The layer 19 comprising the fire retardant material 14 can be located within the body of the material of the core 11 as, for example, an inner layer, or a lamination introduced with a higher ratio or density of fire retardant material 14 than remainder of the material of the core 11. It should be appreciated that the present invention is not limited to an exact or precise position or location of the layer 19 within the material of the core 11 shown in FIGS. 3A and 3B, as the layer 19 may be included at various depths in the material of the core 11 without departing from the scope of the present invention. It is further noted that the layer 19 may extend within the material of the core 11 in any direction relative to the width of the building or expansion joint. For example, the layer 19 may be oriented parallel to the direction in which the joint width extends, perpendicular to the direction in which the joint width extends, or combinations of the foregoing. The layer 19 functions as a fire resistant barrier layer within the material or body of the core 11. Accordingly, the layer 19 can comprise any suitable material providing, for example, fire barrier properties.

Still further, it should be appreciated that the present invention is not limited in the uncompressed and compressed densities and/or layered or non-layered embodiments described herein, that may be used to provide the water resistant and/or fire resistant and/or other properties without adversely affecting the expansion joint sealing system's ability to cycle (expand and contract) to accommodate the movement of substrates between which the system is compressed during installation and operation to maintain the seal. For example, acceptable or preferred performance of expansion joint sealing systems 10 designed and operating in accordance with the present invention requires a balance of a backpressure (e.g., stored strain energy due to compression that provides a recovery or return force) provided by the organic structure of the un-treated material of the core 11 (e.g., the organic cellular structure of the un-treated core without introduction of the one or more water resistant chemistry 12, ultraviolet (UV) stabilizers, polymeric materials and/or the fire resistant material 14) and an amount of a component (liquid or solid) introduced into the organic structure (e.g., by infusing, impregnating, dispersing in, permeating into, putting into, including in, or other equivalent processes), as the amount of the component introduced into the structure of the core 11, whether it is the water resistant chemistry 12, the fire retardant material 14, or other composition, affects the degree to which the backpressure of the un-treated material of the core 11 is dampened or restrained by the introduced component or components. As such, the amount of the components introduced, infused, impregnated, dispersed or permeated with, put into, for example, must not adversely affect the system's ability to cycle (expand and contract) to accommodate the movement of substrates between which the system is compressed to maintain, during operation, the seal provided by the expansion joint sealing system, and in the case of a fire resistant expansion joint sealing system, the system's ability to pass by complying with at least the UL 2079 standard's movement cycling and fire resistance test programs.

One type of fire retardant material that may be used is a water-based aluminum tri-hydrate, also known as aluminum tri-hydroxide (ATH). The present invention is not limited in this regard, however, as other fire retardant materials may be used. Such materials include, but are not limited to, expandable graphite and/or other carbon-based derivatives that may impart fire resistance or retardation, metal oxides and other metal hydroxides, aluminum oxides, antimony oxides and hydroxides, iron compounds such as ferrocene, molybdenum trioxide, nitrogen-based compounds, phosphorus based compounds, halogen based compounds, halogens for example fluorine, chlorine, bromine, iodine, astatine, compounds capable of suppressing combustion and smoke formation, and combinations of any of the foregoing materials. The present invention is not limited in this regard, however, as other fire retardant materials may be used.

In one embodiment, the process by which the chemical agent (e.g., water resistant chemistry 12, ultraviolet (UV) stabilizers, polymeric materials, and/or fire resistant material 14) can be impregnated, infused, dispersed, put into, included in, or otherwise introduced into the cellular structure of the material of the core 11 involves suspending the chemical agent in solution (e.g., in water or in another solvent) and then passing sheets of the cellular material of the core 11 through an apparatus suspended in a bath of the solution, where the apparatus compresses and releases the material of the core 11, allowing the core 11 to draw the solution (and therefore the chemical agent) into the cells of the material of the core 11, resulting in the cellular structure being thoroughly coated and at least partially or fully, filled. The solvent is then driven off through a drying process, leaving the chemical agent dispersed throughout the cellular structure of the material of the core 11. It should be appreciated that alternate processes, as known to those skilled in the art, may be employed to impregnate, infuse, disperse, permeate, put into, included in, or otherwise introduce the water resistant chemistry 12, ultraviolet (UV) stabilizers, polymeric materials, and/or the fire resistant material 14 at least partially or fully, to fill or coat, the matrix and/or exterior or interior of the cells of the core 11.

After the chemical agent (e.g., water resistant chemistry 12, ultraviolet (UV) stabilizers, polymeric materials, and/or the fire resistant material 14) is impregnated, infused, dispersed, put into, included in, or otherwise introduced in the material of the core 11, and the chemical agent and treated core 11 has been appropriately cured, the sheet may be coated with a suitable water resistant or water proof material 20 such as, for example, an elastomeric sealant coating or the like, applied to a surface of the core 11. As described below, the sealant coating should not only provide water resistant and/or water proof characteristics but also provide superior bonding when used in an installation that eliminates the need for scraping, sanding, and grinding of surfaces of substrates forming an expansion joint where the expansion joint sealing system being configured is to be used. In one embodiment, the coating of water resistant or water proof material 20 is applied to an exterior surface of the core 11 to a thickness of approximately about one thirty-second of an inch (0.032 in; 1 mm). The coating is cured per the manufacturer's directions.

In one embodiment, the water resistant or water proof material 20 is comprised of a moisture curing composition, in particular a moisture curing composition based on isocyanate-terminated polymers or silane-terminated polymers. Particular preference is given to moisture curing compositions based on isocyanate-terminated polyurethane polymers and/or based on silane-terminated polyurethane polymers, which are suitable as sealants or elastic adhesives. Examples of such compositions are commercially available under the brand names of Sikaflex® or SikaHyflex® from Sika Corporation, USA. One particularly suitable such composition is, for example, SikaHyflex®-150 LM (low modulus) sealant of Sika Corporation of Lyndhurst, New Jersey USA. In one embodiment, the moisture curing composition to be used as sealant coating is configured to be paintable, for example, to accept a topical application of another coating such as, for example, a color, resealing or protective coating, to coat a surface of a structure in which the expansion joint sealing system 10 is installed. Accordingly, a topical application of a paint or other coating may be applied to an entire façade or other surface of a building or structure without the need to mask off the joint or to discontinue the application processes (e.g., spraying or rolling the surface) of the paint or other coating at the joints. The benefit in eliminating the masking step or in providing a continuous application process, is seen to improve the efficiency in performing this later topical application. In one embodiment, wherein such a later topical application is applied, the moisture curing composition to be used as a sealant coating may be provided in a neutral color.

It should be appreciated that providing a paintable sealant coating such as, for example, the aforementioned moisture curing composition, is an improvement over conventional expansion joint sealing system where a silicone based coatings is not preferred as it has been known to attract dirt and other environmental contaminants more readily than an acrylic coatings, and is seen to preclude the use of anything other than a silicone based coatings in future recoats, if needed, over the expansion joint sealing system. Additionally, an aesthetic advantage may be gained by providing a uniformly applied coating to the surface of the structure, e.g., a building wall or deck, with a same color or protective coating.

It should be appreciated that while described, in one embodiment, as an elastomeric sealant coating, it is within the scope of the present invention to employ, according to embodiments, any suitable water resistant or water proof coating, layer or the like, on a surface or within the material of the core 11, to enhance water resistance or water proofing characteristics of the embodiments. In some embodiment, this water resistant or water proof material 20 may be a polysulfide, silicone, acrylic, polyurethane, poly-epoxide, silyl-terminated polyurethane, silyl-terminated polyether, a formulation of one or more of the foregoing materials with or without other elastomeric components or similar suitable elastomeric coating or liquid sealant materials, or a mixture, blend, or other formulation of one or more of the foregoing. One example of another elastomeric sealant coating for application to a horizontal deck where vehicular traffic is expected is Sikasil® WS-295 sealant, which is a silicone sealant available from Sika Corporation (Lyndhurst, New Jersey). Another elastomeric sealant coating is Pecora 301, which is a silicone pavement sealant available from Pecora Corporation of Harleysville, Pennsylvania. Yet another elastomeric sealant coating is Dow Corning 888, which is a silicone joint sealant available from Dow Corning Corporation of Midland, Michigan. Each of the foregoing elastomeric sealant coatings are traffic grade rated sealants. For vertically-oriented expansion joints, exemplary preferred elastomer coatings include Sikasil WS-295, Pecora 890, Dow Corning 790, and Dow Corning 795. Depending on the nature of the adhesive characteristics of the water resistant or water proof material 20, a primer may be applied to inner or outer surfaces of the material of the core 11 prior to coating the core 11. Applying such a primer may facilitate the adhesion of the water resistant or water proof material 20 to the core 11. It should be appreciated by one of ordinary skill in the art that as used herein the term liquid sealant describes a sealant that is dispensed in a wet or liquid state, shaped or tooled in the field during installation, and then cures to a final finished shape. The wet state is maintained as a result of the liquid sealant being confined in its product packaging until the sealant is dispensed and cures at, for example, ambient conditions. It should also be appreciated that in accordance with one aspect of the present invention the water resistant or water proof material 20 is comprised of a moisture curable sealant composition comprising at least one organic polymer containing silane groups. In one embodiment, the at least one organic polymer is a polyurethane, polyolefin, polyester, polycarbonate, polyamide, poly (meth)acrylate, or polyether or a mixed form of these polymers, preferably a polyurethane polymer.

In one embodiment, the treated and coated sheet of the material of the core 11, as described above, is slit into strips or laminations appropriate to the width of the building and/or expansion joint to be sealed. The resulting strip is typically rectilinear in shape, and has at least one surface coated with the water resistant or water proof material 20. After slitting, a single strip or lamination is manually or mechanically compressed transversely increasing the backpressure (e.g., stored strain energy due to the compression) of the core 11. At the same time, the water resistant or water proof material 20 is formed into an "arch," "dome," or like shape as shown generally at 30 in FIG. 1B. The arched or dome profile of the water resistant or water proof material 20 is advantageous in the design, as described below, for contributing to a compressive force while maintaining a tensionless surface. For example, other sealing products such as, for example, sealant and back rod, or sealing tape solutions, may exist in the art, but do not contain the precompressed, self-expanding arched element, with the arch being transverse to the direction of compression. The precompressed arched shape acts as an elastomeric spring, creating compressive forces against the substrate effecting and contributing to the creation and maintenance of a substantially water tight seal of the building and/or expansion joint once the expansion joint system in installed between the substrates forming the joint. In the case of moving expansion joints, the compressive force of the arched elastomer and backpressure of the underlying compressed core 11, allows the expansion joint sealing system 10 to maintain a weather tight seal throughout the movement regime (e.g., expansion and contraction) of the joint. As should be appreciated, the inherent compressive forces reduce, or largely eliminate, the need for an aggressive adhesion between the sealant and the substrate as is typical of conventional sealant and backer rod type systems that experience tensile stresses at the bond line during movement which often contributes to failure of the bond.

Figure 2B:
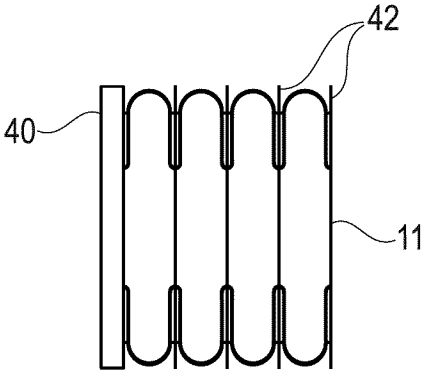
FIG. 2B is a sectional view of FIG. 2A taken along Section B-B of FIG. 2A.
Figure 2A:
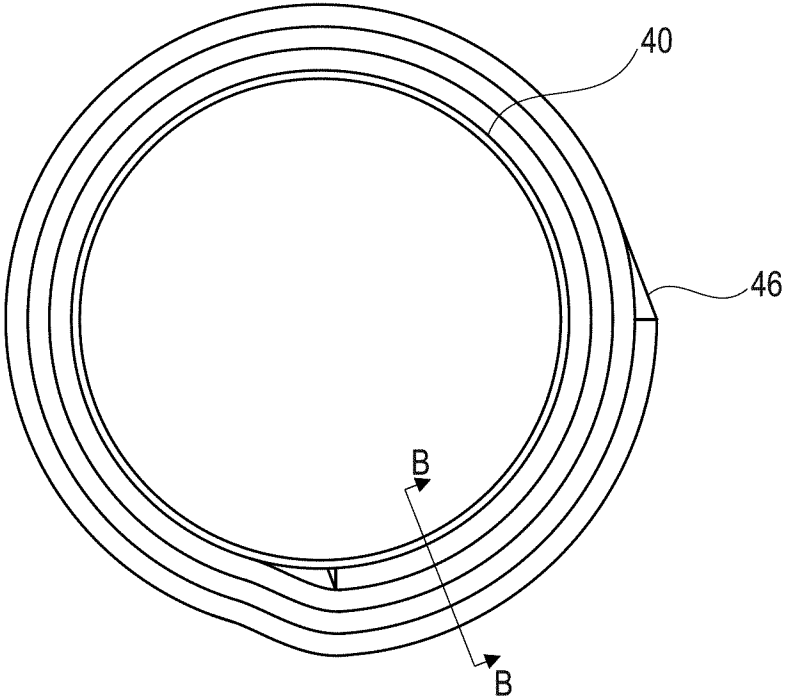
FIG. 2A is a schematic illustration of the compressed and arched expansion joint sealing system of FIG. 1B wound onto a spool for shipment.

Referring now to FIGS. 2A and 2B, in one embodiment, after compression and shaping the expansion joint sealing system 10 is wound about an exterior circumference of a spool made of suitable material such as, for example, cardboard, plastic, or the like. It is noted that while the spool 40 is primarily referred to herein, other suitable substrates and/or devices could be employed in place of spool 40 to hold and/or contain the expansion joint sealing system 10 in a wound configuration such as, for example, an open or solid rod, and so forth, for shipment to a jobsite. The compression and shape can be maintained in each wrap about the exterior circumference of the spool 40 by using a relatively inextensible liner 42, as schematically shown in FIG. 2B. The liner 42 may be comprised of, for example, a plastic film or other suitable material. The liner 42 also can include a pressure sensitive adhesive which is wound against the material of the compressed core 11 and the water resistant material 20 disposed on the core 11. This pressure sensitive adhesive can be used as an installation aid. As the compressed material of the core 11 is wound around the exterior circumference of the spool 40, the core, depending on its overall length, overlaps itself multiple times. The liner 42 keeps each wrapping discrete and prevents adhesion between the windings. At the conclusion of the winding process the liner 42 is secured to itself by means of, for example, adhesive tape as shown generally at 46 (FIG. 2A). It is advantageous that an inexpensive liner 42 be used to maintain the compressed shape and size of the expansion joint sealing system 10 in the form of a coil about the exterior circumference of the spool 40, as more expensive packaging options to maintain the desired shape and level of compression are less desirable.

In one embodiment, the treated and coated sheet of the material of the core 11, as described above, is slit into two or more strips or laminations, the number and width of the slitting depending on the desired size of the expansion joint sealing system. After stripping, the two or more strips or laminations 16 are compiled and then compressed transversely and held at such compression as a unitary structure in a suitable fixture, according to embodiments, to maintain the backpressure stored therein. Similarly, a core 11 comprising a solid block of material is compressed and held at such compression in the suitable fixture to maintain the backpressure stored therein. The fixture is set at a width slightly greater than that which the expansion joint is anticipated to experience at the largest possible movement of the adjacent surfaces. At this width, the treated material of the core 11 (as laminations or a block) is coated with the water resistant or water proof material 20 at one or more exterior surfaces, according to embodiments. In one embodiment, illustrated in FIG. 1C, the coating of the water resistant or water proof material 20 is tooled or otherwise configured to create a "bellows" shape 32 including a series of "arch", "dome" or like shapes or other suitable profile that can be compressed in a uniform and aesthetic fashion while being maintained in a virtually tensionless environment.

In one embodiment, a second or more coatings is/are applied to the treated material of the core 11. For example, an additional coating of the water resistant material 20, an intumescent material and/or shielding coating may be applied to the material of the core 11 held in compression in the fixture, and similarly formed into the arched or domed profile as illustrated in FIG. 1B or the bellows shape 32 as illustrated in FIG. 1C. As described in commonly owned U.S. Pat. No. 8,365,495 and other commonly owned patents, one type of intumescent material suitable for use in the herein described expansion joint sealing system 10 is a caulk having fire barrier properties. A caulk is generally a silicone, polyurethane, polysulfide, sylil-terminated-polyether, or polyurethane and acrylic sealing agent in latex or elastomeric base. Fire barrier properties are generally imparted to a caulk via the incorporation of one or more fire retardant agents. One preferred intumescent material is 3M CP25WB+, which is a fire barrier caulk available from 3M of St. Paul, Minnesota. In one embodiment, a pick-proof or pick-resistant elastomer coating may be applied to one or more surfaces of the material of the core 11. An example of a pick-proof coating includes, for example, Pecora Dynaflex SC or equivalent.

Figure 2D:
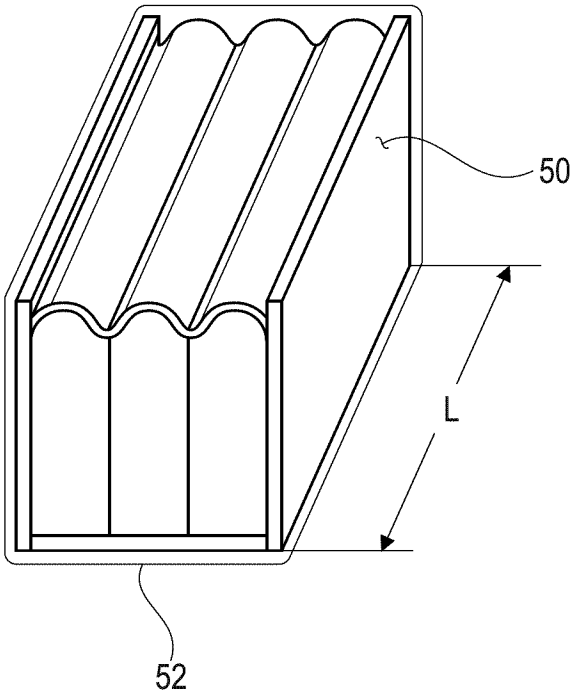
FIGS. 2C and 2D are schematic illustrations of an end view and a prospective view, respectively, of the compressed and bellows shaped expansion joint sealing system of FIG. 1C packaged for shipment.
Figure 2C:
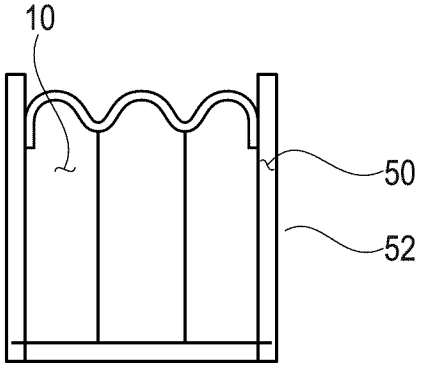

After the coatings are cured in place on one or more surfaces of the material of the treated core 11 and while the treated core 11 is held at the prescribed compressed width, the expansion joint sealing system 10 is removed from the fixture and packaged for shipment to the jobsite. Optionally, prior to removal the fixture, the expansion joint sealing system 10 is further compressed to less than a nominal width of the building and expansion joint into which the system is intended for installation. This further compressed the expansion joint sealing system 10 is then removed from the fixture and packaged for shipment to the jobsite. As noted above, packaging includes winding the expansion joint sealing system 10 illustrated in FIG. 1B about the exterior circumference of the spool 40, as illustrated in FIGS. 2A and 2B. As illustrated in FIGS. 2C and 2D, for the expansion joint sealing system 10 illustrated in FIG. 1C, packaging includes compressing the expansion joint sealing system 10 cut in a predetermined length L, for example, a length of ten feet (10 ft.; 3.048 m), disposing the system 10 between two relatively rigid hardboards 50, and then enclosing the system 10 and hardboards 50 by a package wrapping 52 such as, for example, a shrink-wrap plastic film. As described below in installation methods, the packaging is designed to hold the expansion joint sealing system 10 from prematurely expanding outwardly (due to a release of stored backpressure) prior to installation into the intended building and/or expansion joint.

As noted in the Background Section of the present disclosure, typical installation of a new expansion joint sealing system, whether during initial construction or subsequent maintenance operations, requires preparation of surfaces of the substrates forming the building and/or expansion joint into which the expansion joint sealing system is being installed. Preparation and/or restoration of the surfaces of the substrates may be required so that the surfaces accept adhesive or other sealant aiding the bond between the expansion joint sealing system and the substrates. Preparation and restoration conventionally includes, for example, cleaning, scraping, abrading, sanding, grinding, or other treatment to remove dirt, old sealant residue, or other materials that may inhibit formation of a good bond and adhesion between the substrates and the expansion joint sealing system. As can be appreciated scraping, abrading, sanding, and/or grinding the substrates and materials on the surface of the substrates can release harmful dust or other contaminants such as, for example, silica, as airborne particles. To minimize exposure to such harmful dust and contaminants, federal, state and local safety and other building and health organizations establish regulations that require installers use dust collection equipment attached to all cutting, scraping, sanding, and grinding tools as well as require that installers use of personal protective equipment (PPE). As noted in the Background Section, there are cost and other health and safety disadvantages to use of the dust collection equipment and PPE. The expansion joint sealing systems 10 and installation methods described herein are seen to substantially minimize, if not eliminate, the exposure to such harmful dust and contaminants, while minimizing health and safety disadvantages to use of safety equipment by, for example, eliminating a need for scraping, abrading, sanding, and grinding of surfaces of substrates forming the expansion joint to prepare the surfaces to accept adhesive or other sealant aiding the bond and adhesion between the expansion joint sealing system and the substrates forming the joint.

Figure 4:
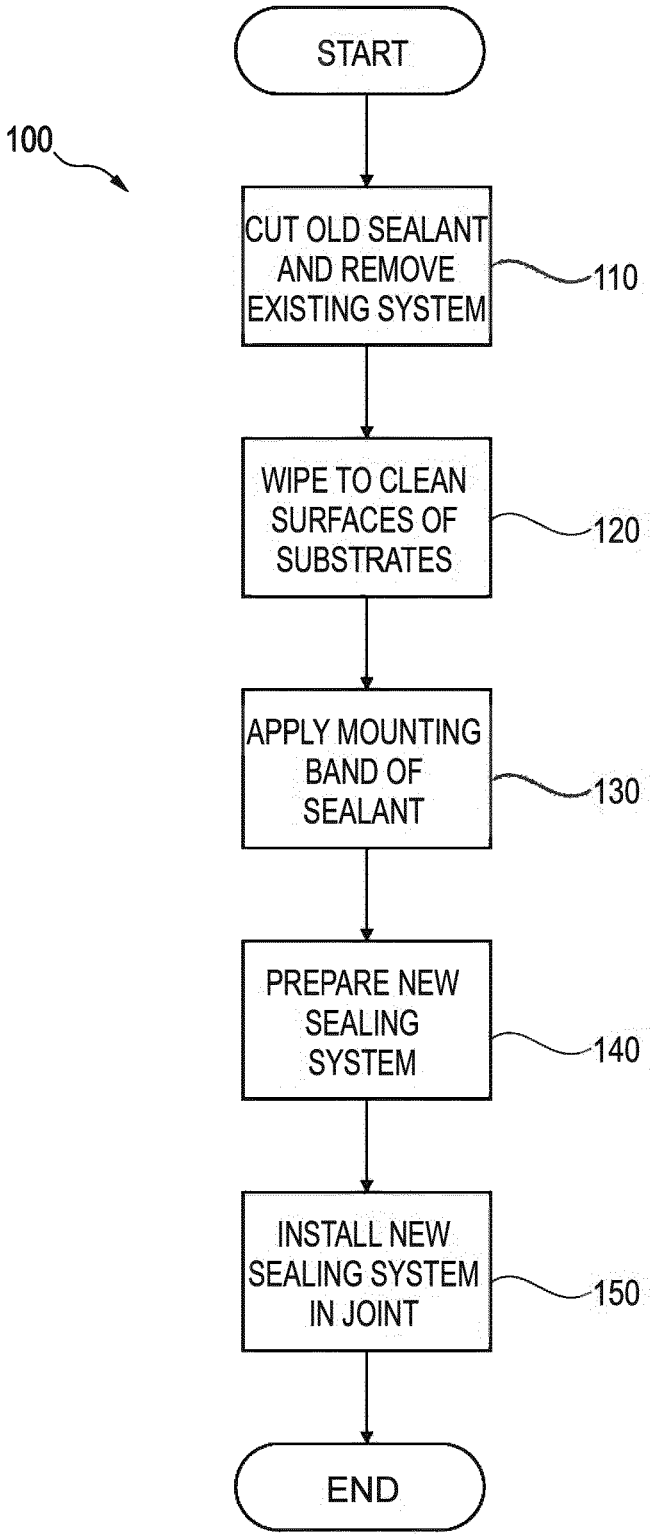
FIG. 4 depicts a safer, dustless method for installing an expansion joint sealing system, according to an embodiment.
Figure 5A:
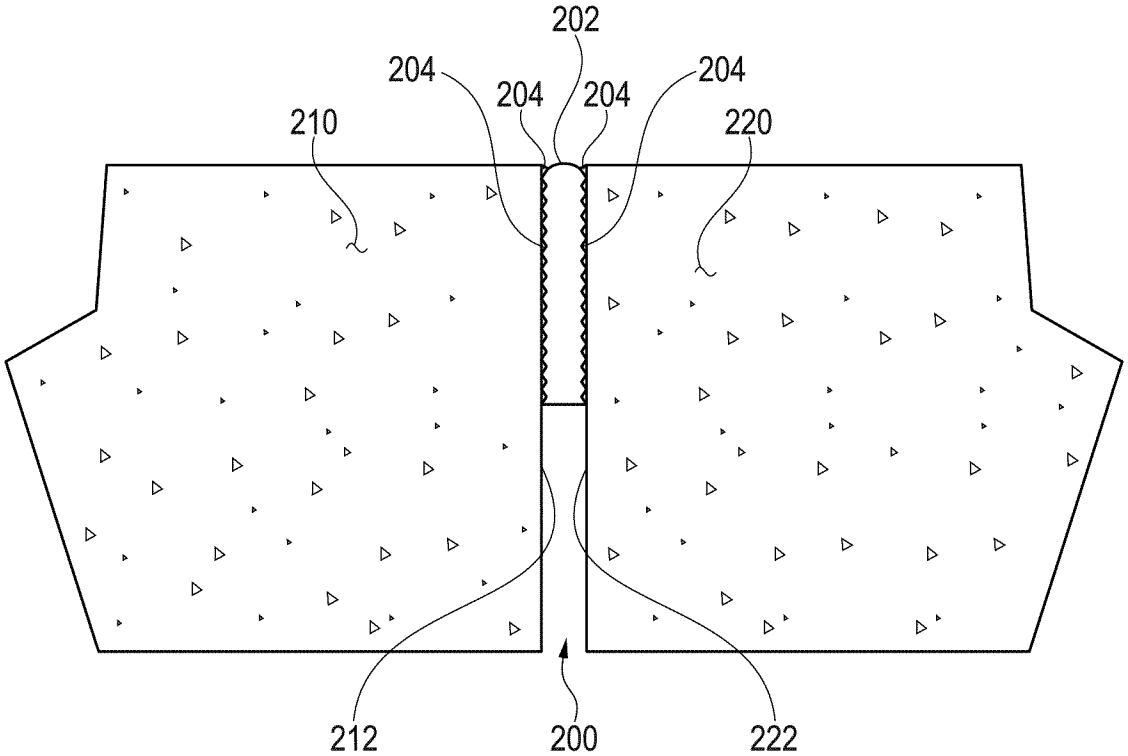
FIGS. 5A to 5C are schematic partial section views of steps of the method of FIG. 4, according to an embodiment.
Figure 5B:
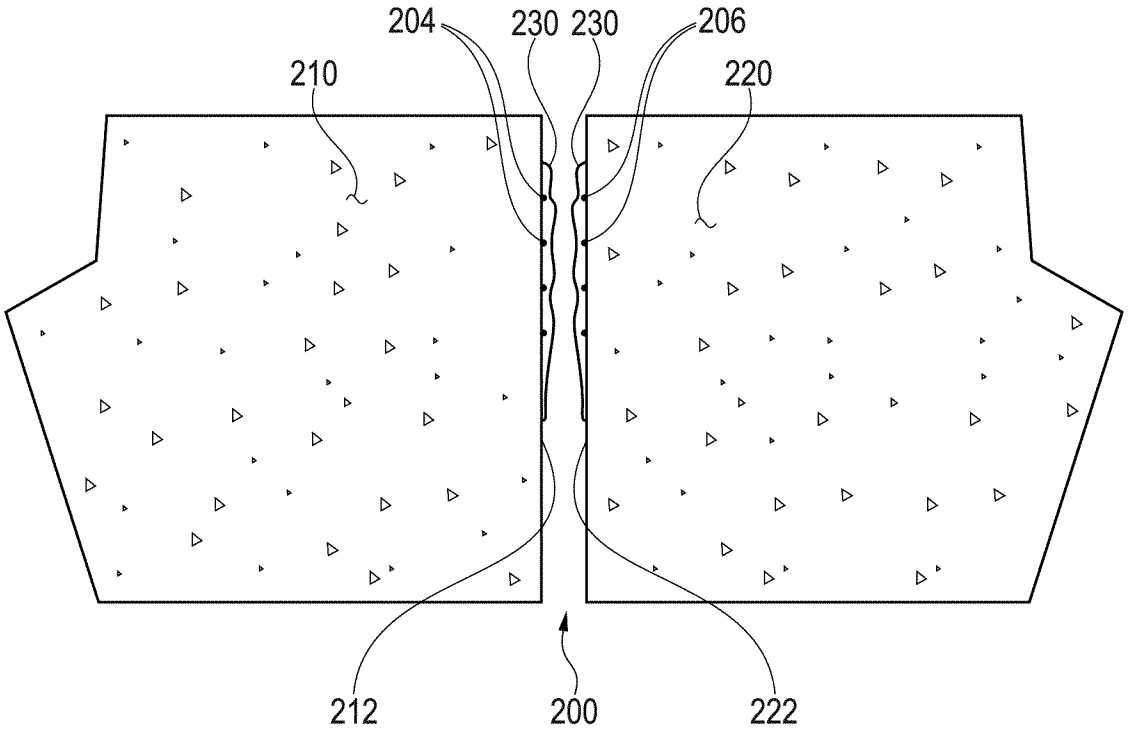
Figure 5C:
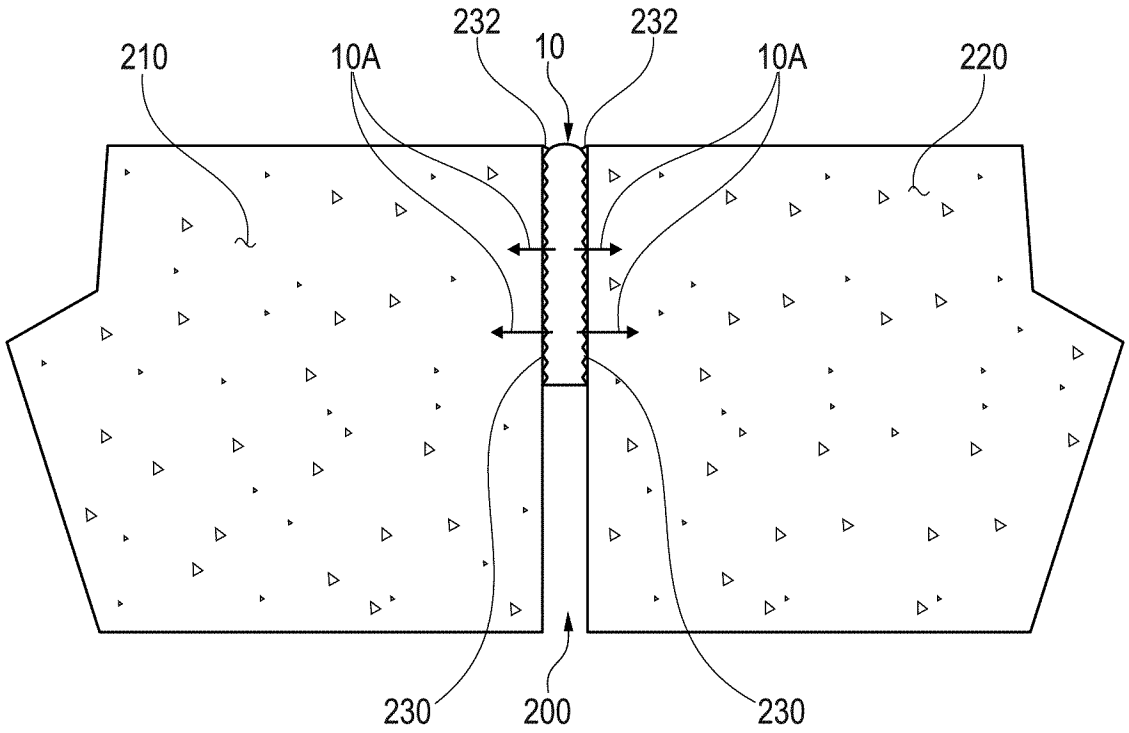

In accordance with aspects of the present invention, and with reference to FIGS. 4 and 5A to 5C, a method for safer, dustless installation 100 of an expansion joint sealing system such as, for example, the above described water and/or fire resistant expansion joint sealing system 10, into a gap or building or expansion joint 200 formed between substrates in which a previous system was installed and is to be removed for installation of a new sealing system, includes the following steps. At a Step 110 the method includes cutting sealant 204 to remove the existing expansion joint sealing system 202 held in location between surfaces 212 and 222 at opposing faces of substrates 210 and 220 forming the joint 200 (FIG. 5A). The cutting of the sealant 204 within the joint 200 is performed with, for example, a knife, saw, reciprocating saw or cutter, or similar instrument (not shown), as close to the substrates 210 and 220 as can be achieved. The cutting of the sealant 204 allows for a removal of the existing system 202 while leaving any embedded residue 206 of the sealant 204 from the existing expansion joint sealing system 202 on the surfaces 212 and 222 of the substrates 210 and 220. For example, conventional steps of mechanically grinding, scraping or abrading surfaces of the substrate to prepare substrates or to remove residue of a previously installed and removed joint sealing system, are not required. At a Step 120 the surfaces 212 and 222 may be wiped with a solvent such as, for example, water, acetone or a similar solvent, with, for example, a lint free wipe or rag, to remove any particulates of the sealant, dirt or other materials that may inhibit adhesive bonding, from the surfaces 212 and 222 of the substrates 210 and 220. It should be appreciated that this cleaning step leaves any surface deformation or remaining residue 206 of the previously applied sealant 204 on or embedded in the surfaces 212 and 222 of the substrates 210 and 220. At a Step 130 a mounting band 230 of liquid sealant such as, for example, SikaHyflex®-150 LM sealant, is applied to the surfaces 212 and 222 of the substrates 210 and 220 (FIG. 5B). At a Step 140 a shipping package including the compressed water and/or fire resistant expansion joint sealing system 10 is brought in proximity to the installation site and the shipping package is removed by cutting the liner 42 (FIGS. 2A and 2B) or wrapping 52 (FIGS. 2C and 2D). Once the liner 42 or wrapping 52 is removed, the compressed water and/or fire resistant expansion joint sealing system 10 begins to slowly expand outwardly. Optionally, an additional mounting band of liquid sealant may be applied to the surfaces of the expansion joint sealing system 10. At a Step 150 the compressed, self-expanding expansion joint sealing system 10 is installed into the expansion joint 200 in a position proximate to and over the wet mounting band 230 applied to the surfaces 212 and 222 (FIG. 5C). The stored strain energy of compression or backpressure of the expansion joint sealing system 10 causes the material of the core 11 to continue to expand outwardly (in directions depicted by arrows 10A) to embed the expansion joint sealing system 10 into the mounting band 230 of liquid sealant and against the substrates 210 and 220 to complete the installation by securing the system 10 in place between the substrates 210 and 220. It should be appreciated that once installed in the position between the surfaces 212 and 222 the backpressure, alone and together with the mounting band 230 of the liquid sealant, is sufficient to support the expansion joint sealing system 10 in the expansion joint 200. Optionally, an additional bead 232 (e.g., corner bead) of liquid sealant is applied to and between a portion of a top surface of the water resistant or water proof material 20 and the surfaces 212 and 222 of the substrates 210 and 220 to enhance a bond line therebetween and/or to encapsulate any dust and contaminants exposed on the surfaces 212 and 222. Once the mounting hand 230 of liquid sealant cures, a bond line between the expansion joint sealing system 10 and the mounting band 230, and optionally bead 232, is never in tension. Similarly, the bond between the mounting band 230 of sealant and any residue of sealant embedded in surfaces 212 and 222 of the substrates 210 and 220 is also never in tension. Any joint movement at the sealant joint caused by thermal, wind, seismic, or other building movement, is absorbed, free of tension, in the water resistant or water proof material 20 (whether in the single arched or series of bellows shaped material) and core 11 of the expansion joint sealing system 10. For example, both the water resistant material 20 and core 11 of the preformed, precompressed expansion joint sealing system 10 are seen to simply fold and unfold (e.g., expand and contract) to accommodate movement of the substrates 210 and 220 forming the joint 200.

With reference to FIGS. 4, 5B and 5C, the method of safer, dustless installation 100 of the above described water and/or fire resistant expansion joint sealing system 10 into a building or expansion joint 200 in which there was not a previous system installed, for example, in a newly constructed structure, is completed by performing Steps 120 to 150. It should be appreciated that when an expansion joint sealing system is installed in a newly constructed structure it is typical for surfaces of opposing faces of substrates forming an expansion joint, for example, the surfaces 212 and 222 of substrates 210 and 220 forming the joint 200 as illustrated in FIG. 5A, to be prepared to accept an expansion joint sealing system in a conventional manner by scraping, abrading, sanding, grinding, or other treatment to level surface deformations and/or to remove dirt, residue, or other materials that may inhibit formation of a good bond and adhesion between the substrates and the expansion joint sealing system. As should also be appreciated in accordance with the present invention the above-described safer, dustless method for installation 100 of the water and/or fire resistant expansion joint sealing system 10 as new or to replace an existing system already installed into the building or expansion joint 200 eliminates the need for scraping, abrading, sanding, and grinding of surfaces 212 and 222 of substrates 210 and 220 forming the expansion joint 200 to prepare the surfaces 212 and 222 to accept adhesive or other sealant 230 aiding the bond and adhesion between the newly installed expansion joint sealing system 10 and the substrates 210 and 220 forming the joint 200. As noted above, the elimination or at least substantial minimization of dust and airborne contaminants eliminates or at least makes optional the need for use of dust collection equipment and PPE by installers.

Embodiments disclosed herein, particularly the aforereferenced design, address shortcomings of previous designs, solve problems associated with caulk and backer rod designs, remove installation steps that result in the generation of airborne particles and/or particulates that are detrimental to worker, tenant, and public health and safety if aspirated, reduce or make optional the need for PPE and/or specialized equipment to capture deleterious airborne particles and/or particulates, and improve upon the teachings of prior art systems and methods of installation in a cost efficient manner. Moreover, in the spooled or coiled packaging form, expensive and wasteful packaging materials can be replaced with an inexpensive plastic liner and inexpensive cardboard spool. The coiled form greatly reduces other packaging materials as well, such as boxes, and skids. The coiled form also makes on site handling and installation much more efficient and simpler.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the detailed description and the appended claims as understood by those of skill in the art. Thus, various embodiments, including constructions, and so forth described herein and described in the afore-referenced priority applications, can be combined in any combination and in any order.

What is claimed is:

1. A safer, dustless method for installing a precompressed expansion joint sealing system, the method comprising:

locating a first substrate and a second substrate, the second substrate arranged coplanar with the first substrate and being spaced therefrom by a gap formed between opposing surfaces of the first substrate and the second substrate;

preparing the opposing surfaces of the first substrate and the second substrate without mechanically grinding, abrading or scraping by wiping the opposing surfaces with a solvent leaving any surface deformations and residue;

applying a mounting band of a liquid sealant to the opposing surfaces of the first substrate and the second substrate;

disposing a precompressed expansion joint sealing system in the gap by locating the expansion joint sealing system in a position between the opposing surfaces and at least in one of proximity to or within the mounting band of the liquid sealant applied to the opposing surfaces of the first substrate and the second substrate; and maintaining the precompressed expansion joint sealing system in the position in the gap until the precompressed expansion joint sealing system expands outwardly toward the opposing surfaces, embeds within the mounting band of sealant and secures the expansion joint sealing system in the position between opposing surfaces of the first substrate and the second substrate.

2. The safer, dustless method for installing of claim 1, wherein the method further comprises:

applying a bead of liquid sealant to and between a portion of a top surface of the precompressed expansion joint sealing system and the opposing surfaces of the first substrate and the second substrate.

3. The safer, dustless method for installing of claim 1, wherein the method further comprises:

prior to the preparing the opposing surfaces of the first substrate and the second substrate, steps of:

locating an existing joint sealing system installed in the gap between the first substrate and the second substrate; and removing the existing joint sealing system by cutting sealant between the existing joint sealing system and the first substrate and the second substrate; and wherein the preparing the opposing surfaces of the first substrate and the second substrate by wiping further includes wiping the opposing surfaces with the solvent and leaving any surface deformation and embedded residue of sealant remaining from the removed joint sealing system on or embedded in the opposing surfaces of the first substrate and the second substrate without mechanically grinding, scraping or abrading the substrates either to prepare the substrates or to remove the residue of the previously installed and removed joint sealing system.

4. The safer, dustless method of installing of claim 1, wherein the installed precompressed expansion joint sealing system is a water resistant and/or fire resistant precompressed expansion joint sealing system.

5. The safer, dustless method of installing of claim 4, wherein the water resistant and/or fire resistant precompressed expansion joint sealing system includes fire retardant material introduced into a core of the expansion joint sealing system and has as a compressed density in a range of about 160 $kg/m^3$ to about 800 $kg/m^3$ and the expansion joint sealing system is configured to pass testing provided by UL 2079.

6. The safer, dustless method of installing of claim 4, wherein the installed precompressed expansion joint sealing system further includes a water resistant or water proof resistant coating applied to a surface of the precompressed expansion joint sealing system.

7. The safer, dustless method of installing of claim 6, wherein the water resistant or water proof resistant coating is paintable.

8. The safer, dustless method for installing of claim 1, wherein the liquid sealant is based on isocyanate-terminated polyurethane polymers and/or based on silane-terminated polyurethane polymers.

* * * * *